US011589718B2

(12) United States Patent
Pegden et al.

(10) Patent No.: US 11,589,718 B2
(45) Date of Patent: Feb. 28, 2023

(54) MOUNTING METHOD AND/OR APPARATUS FOR MOUNTING A TOILET SEAT

(71) Applicant: Norcros Group (Holdings) Limited, Hampshire (GB)

(72) Inventors: Peter James Harold Pegden, Kingswood (GB); Jonathan Harry Tooley, Hampshire (GB); Luke Michael Ritchie Semple, Hampshire (GB)

(73) Assignee: Norcros Group (Holdings) Limited

( * ) Notice: Subject to any disclaimer, the term of this patent is extended or adjusted under 35 U.S.C. 154(b) by 35 days.

(21) Appl. No.: 17/199,634

(22) Filed: Mar. 12, 2021

(65) Prior Publication Data

US 2021/0196089 A1 Jul. 1, 2021

Related U.S. Application Data

(62) Division of application No. 16/488,066, filed as application No. PCT/GB2017/050473 on Feb. 23, 2017, now abandoned.

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/240
See application file for complete search history.

(56) References Cited

U.S. PATENT DOCUMENTS

| | | | | |
|---|---|---|---|---|
| 8,362,907 | B1 * | 1/2013 | Canfield | E03D 1/00 340/605 |
| 9,538,888 | B2 * | 1/2017 | Chen | A47K 13/26 |
| 9,943,198 | B2 * | 4/2018 | Yang | A47K 13/26 |
| 2016/0029861 | A1 * | 2/2016 | Pegden | C09J 5/00 4/240 |

FOREIGN PATENT DOCUMENTS

| | | | |
|---|---|---|---|
| CN | 203576408 | U | 5/2014 |
| CN | 204105870 | U | 1/2015 |
| EP | 1616520 | A2 | 1/2006 |
| WO | 2014/166775 | A1 | 10/2014 |

OTHER PUBLICATIONS www.gorillastrong.com dated Oct. 20, 2015 printed Jun. 13, 2022 (Year: 2022).*

* cited by examiner

*Primary Examiner* — Christine J Skubinna
(74) *Attorney, Agent, or Firm* — Dinsmore & Shohl LLP

(57) ABSTRACT

A method and apparatus for mounting a toilet seat hinge to a toilet pan uses an adhesive. The adhesivised surface of the hinge is held clear of the pan until correct positioning is established. Thereafter the adhesivised surface is displaced directly into contact with the pan.

7 Claims, 3 Drawing Sheets

MOUNTING METHOD AND/OR APPARATUS FOR MOUNTING A TOILET SEAT

REFERENCE TO RELATED APPLICATION

This application is a U.S. Divisional Application of U.S. Utility application Ser. No. 16/488,066 filed Aug. 22, 2019 which is a U.S. 371 Application of PCT/GB2017/050473, filed Feb. 23, 2017, the entire content of which is incorporated herein by reference.

FIELD OF THE INVENTION

This disclosure provides a method of and/or apparatus for mounting a toilet seat on a toilet pan.

BACKGROUND OF THE INVENTION

A toilet seat is typically fixed to a toilet pan by way of two spaced hinges fixed to spaced positions on or adjacent to the rear edge of the seat. One part of each hinge is secured to the seat and the other part of each hinge is secured to the pan. That part of the hinge attached to the pan is typically fixed by passing a threaded rod or shaft through a vertical hole extending downwards from the top face of the pan, and then applying a locking nut to that part of the rod or shaft that projects from the opposite end of the hole.

A problem that arises from this arrangement is that the holes in the pan are invariably larger in diameter than the diameters of the fixing rods or shafts and, over time and while being subjected to working loads, the rods displace relative to the axes of the holes in the pan, the locking nuts work loose and the toilet seat thus moves with respect to the pan.

Various methods have been adopted, in the past, to reduce the problem. One common method involves positioning rubber or plastics washers between the hinges and the pan but this solution has limited effectiveness for a number of reasons. Firstly the materials from which the washers are formed deteriorate with time. Further, they deteriorate with exposure to a number of toilet cleaning chemicals. Thirdly toilet pans are generally formed from vitreous enamel which has a very smooth, low friction surface. As a result, once tension on the fixing rods lessens, the washers can slide freely over the surface of the pan.

It is an object of the disclosure to provide a method and apparatus which will go at least some way in addressing the drawbacks mentioned above; or which will at least provide a novel and useful alternative.

SUMMARY OF THE INVENTION

Accordingly, in one aspect, the disclosure provides a method of mounting a toilet seat hinge on a toilet pan, said toilet seat hinge including a hinge base; and an adhesive to adhere said hinge base to said pan; said method being characterised in that a spacer is provided to maintain clearance between said adhesive and said pan while the desired position of said hinge relative to said pan is established, said method including displacing or deforming said spacer while pressing said hinge into contact with said pan.

Preferably said method is applied to a toilet seat hinge having a fixing rod locatable through a hole in said pan.

Preferably said method includes providing said adhesive so as to encircle said hole.

Preferably said method comprises applying said adhesive to a fixing component or grip gasket forming part of said hinge base.

In a second aspect the disclosure provides a hinge for mounting a toilet seat on a toilet pan, said hinge including a hinge base having a contact surface for adhesive engagement with said pan, said hinge being characterised by the inclusion of a spacing facility configured to maintain a space between said contact surface and said pan, said spacing facility being displaceable or deformable by the application of a force to said hinge base against said pan.

Preferably said hinge further includes a fixing rod locatable through a hole in said pan.

Preferably said hinge base comprises a fixing part which includes said contact surface; and a cover engageable over said fixing part.

Preferably said fixing part further includes an aperture through which, in use, said fixing rod may pass.

Preferably said contact surface has engaged therewith, a bonding component adhesivised on both sides thereof.

Preferably said bonding component is formed from very high bond (VHB) tape.

Preferably said spacing facility is formed integrally with said contact surface and is configured to fracture upon displacement of said hinge base into contact with said pan.

Preferably said contact surface has apertures to receive said spacing facility as said hinge is displaced into contact with said pan.

Alternatively said spacing facility is displaceable relative to said contact surface as said contact surface is brought into contact with said pan.

In a third aspect the disclosure provides a toilet seat hinge including a hinge base; a pillar mounted to said hinge base for pivotal engagement with a toilet seat; and a fixing member to fix said pillar to said hinge base; said hinge being characterised in that an intermediate mount is provided, said fixing member fixing said pillar to said intermediate mount and said intermediate mount being rotatably located in said hinge base.

Preferably said hinge base includes a fixing part engageable with a toilet pan, and a cover engageable over said fixing part, said pillar being mounted on said cover.

Many variations in the way the disclosure may be performed will present themselves to those skilled in the art, upon reading the following description. The description should not be regarded as limiting but rather as an illustration, only, of one manner of performing the disclosure. Where appropriate any element or component should be taken as including any or all equivalents thereof whether or not specifically mentioned.

BRIEF DESCRIPTION OF THE DRAWINGS

Working embodiments of the disclosure are now described below with reference to the accompanying drawings in which.

DETAILED DESCRIPTION OF THE INVENTION

Figure 1:
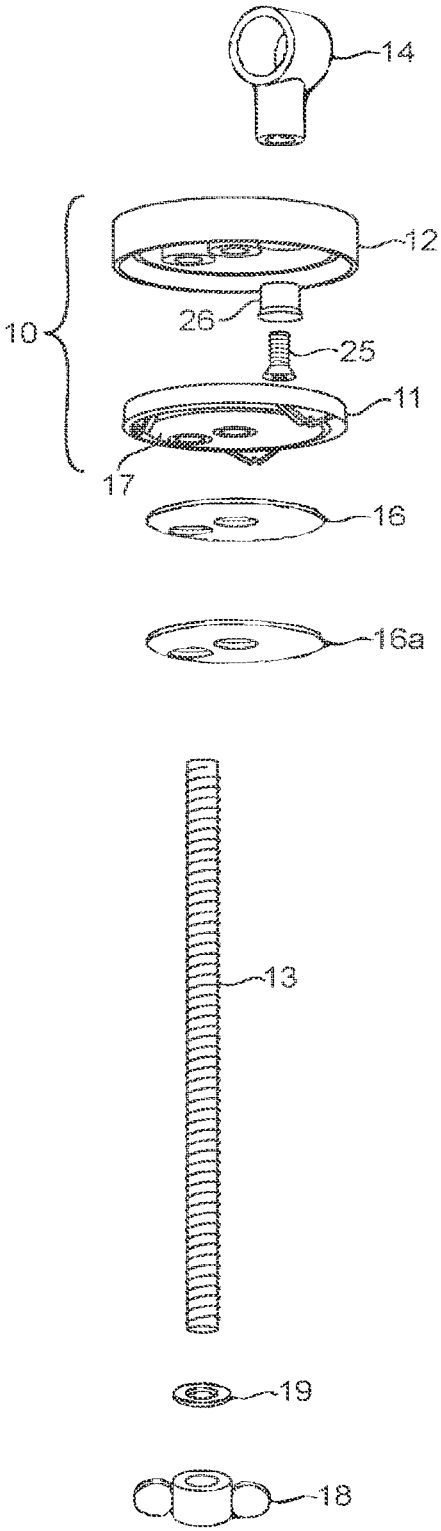
FIG. 1 is an isometric exploded view of a combination of components which, together, form a toilet seat hinge according to the disclosure.
Figure 2:
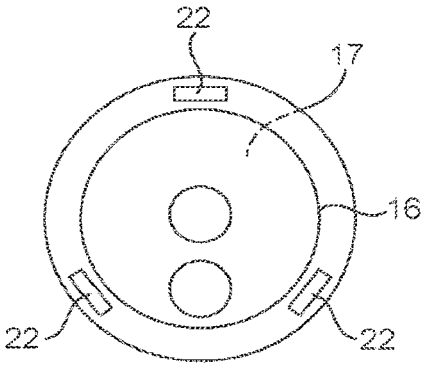
FIG. 2 is a plan view of a contact surface included in the fixing member of FIG. 1.

Referring to FIGS. 1 to 3, a first embodiment of toilet seat hinge according to the disclosure includes a hinge base 10 comprising a fixing part 11 and a cover 12, a threaded fixing bolt 13, and a pillar 14. The fixing part 11 is fixed to the upper surface of a toilet pan 15 by an adhesive, preferably a very high bond (VHB) double sided tape 16, which adheres on one side to a contact surface 17 of the fixing part 11, and on the other side to the toilet pan 15. A protective paper covering 16*a* is provided to cover the VHB tape on that surface that is to bond to the pan, prior to installation of the hinge.

At installation with the fixing part 11 secured in position, the cover 12 is located over the fixing part and is secured in position by the threaded fixing bolt 13. In the conventional manner, the bolt 13 is engaged at one end in the cover 12, is passed through locating holes (not shown) in the pan 15, and is secured on the underside of the pan using a nut 18 and washer 19. Tightening of the nut 18 clamps the contact surface 17, with attached VHB tape 16, against the toilet pan and thus ensures that a very secure connection is achieved between the hinge and the pan.

In the embodiment shown in FIG. 1, the hinge is what is referred to in the trade as a bottom-fixing hinge. In the embodiment shown in FIGS. 4 & 5, the hinge is a top-fixing hinge. The disclosure described herein is applicable to both forms of hinge.

A characterising feature of the disclosure is that the hinge can be moved freely and located in the desired position relative to the pan, and then secured in position on the pan, without the need for any trial assembly. To this end a spacing facility is provided that is configured to space the contact surface 17, and the VHB tape (with cover paper 16*a* removed therefrom) from the pan while the hinge base is positioned in the correct location. When in the correct location, the hinge base is displaced toward the pan, and the spacing facility is displaced or deformed until the VHB tape comes into contact with the pan. The displacing force applied to the hinge base may be applied manually and/or may be effected by tightening the nut 18.

Referring to the embodiment shown in FIGS. 1 to 3, the spacing facility is formed as an integral part of the hinge base and projects from the periphery of the contact surface 17. As can be seen most clearly in FIG. 2, three projections 20 are spaced around the periphery of the contact surface 17 and project outwardly from the plane of the surface. The projections are preferably equi-spaced around the periphery to provide the necessary support function, and each has a vee-shaped central formation 21 to assist deformation and/or fracturing. Underlying each of the projections is a recess 22.

Figure 3A:
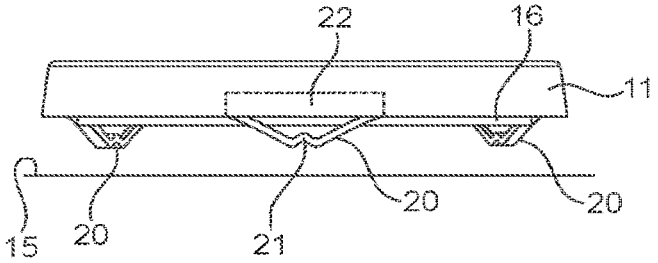
FIGS. 3*a*-3*c* are successive views of a contact surface being displaced into contact with a toilet pan.
Figure 3B:
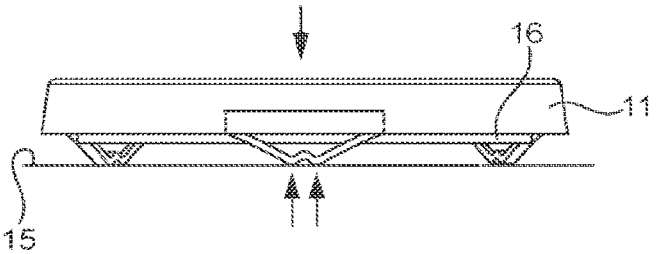
Figure 3C:
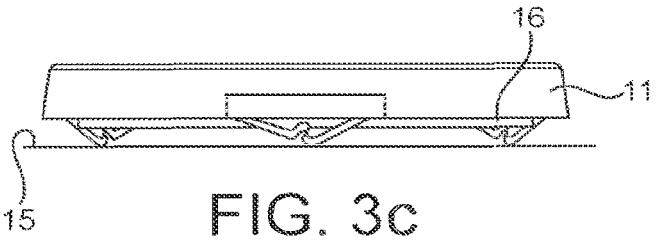

As can be seen in FIGS. 3*a* to 3*c*, when the hinge base is first located against the toilet pan 15, and with the protective covering 16*a* removed, the projections 20 maintain the under-surface of the VHB tape clear of the pan. As can be seen in FIG. 3*c*, with only the projections 20 contacting the pan, the fixing part 11 may be displaced over the pan surface until the final fixing position is established. Thereafter, as shown in FIG. 3*c*, a downward displacing force is applied to the fixing part 11 which causes the projections to distort and possibly to fracture. The distorted or fractured remnants of the protections are then received in the recesses 22. It will be appreciated that, as the projections distort or fracture, the VHB tape contacts the pan and bonds the fixing part 11 to the pan 15.

Figure 4:
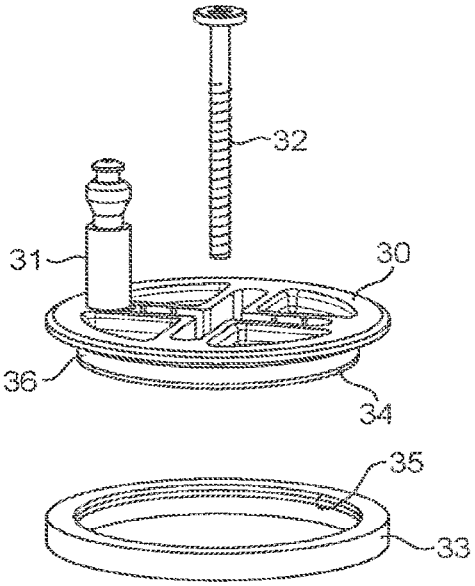
FIG. 4 is an exploded isometric view of a second embodiment of hinge according to the disclosure.

Referring now to FIGS. 4 and 5, parts of a second embodiment of hinge are shown, this embodiment including a hinge base 30, a hinge connector 31 projecting upwardly from the base, a fixing bolt 32, and a spacer 33. A disc 34 of VHB tape is fixed to the underside of the base 30 and the underside of this disc is maintained out of contact with the surface of the toilet pan, while the base is positioned in the desired location relative to the pan.

Figure 5A:
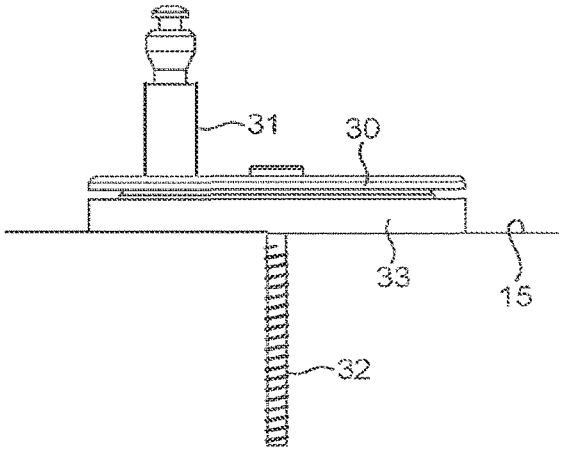
FIGS. 5*a* and 5*b* are successive steps in securing the components of FIG. 4 to a toilet pan.
Figure 5B:
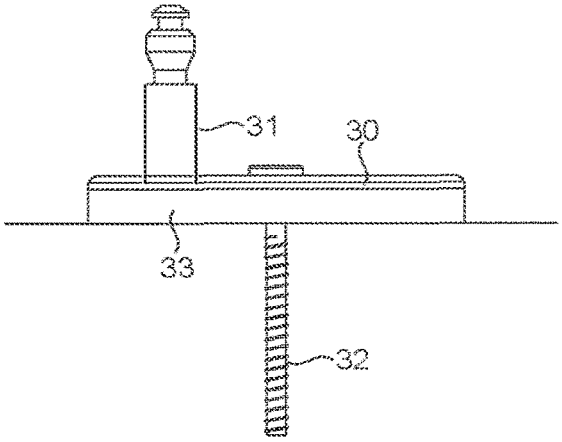

In this particular embodiment the spacer comprises a ring having an inner annular surface 35 that engages a downward spigot 36 forming part of the base 30. The spigot 36 may be a firm frictional fit within the spacer 33 or the surfaces 35 and 36 may be formed with complimentary projection and socket. Whatever the case, the inter-engagement of base and spacer is configured to ensure the VHB tape is held clear of the pan during positioning of the base 30 but, once the base is correctly positioned, the application of manual pressure, or pressure applied by tightening the fixing bolt 32, will overcome any resistance between the base 30 and the spacer 33, causing the spigot 36 to slide within the spacer until the VHB tape contacts and bonds to the surface of the pan. FIG. 5*a* shows the base 30 in the raised position relative to the pan 15 while FIG. 5*b* shows the base 30 displaced so that the VHB tape is bonded to the pan.

Figure 6A:
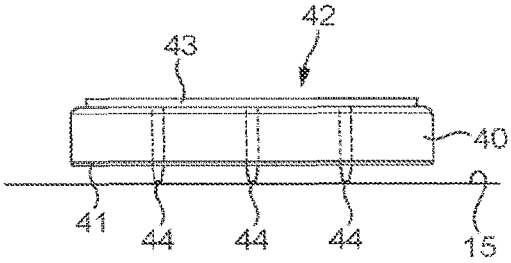
FIGS. 6*a* and 6*b* are successive steps in the operation of a third embodiment of hinge according to the disclosure.
Figure 6B:
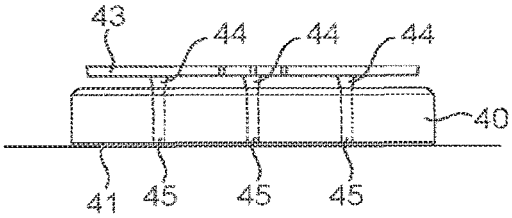

Referring now to FIGS. 6*a* and 6*b*, parts of a third embodiment of the disclosure are shown comprising a hinge base 40 for connection to a surface 15 of a toilet pan using a disc 41 of VHB tape. During positioning of the base 40 relative to the pan 15 the base is maintained clear of the pan by a spacer 42 which comprises a base plate 43 having a number of spikes 44 projecting downwardly therefrom. The base 40 and VHB tape 41 are formed with holes 45 in positions that correspond to the positions of spikes 44 and thus the spikes can be engaged through the holes 45 to engage the surface 15 of the pan. It will be seen that the length of the spikes 44 is greater than the thickness of the base 40 and thus with the spacer 42 fully engaged with the in the desired location, it may be displaced downwardly whereupon the spikes 44 disengage from holes 45 and the VHB disc can engage and bond to the surface 15 as shown in FIG. 6*b*. The spacer 42 can then be removed completely.

Any suitable means can be provided to maintain the base 40 in the upward position shown in FIG. 6*a*, during positioning of the base 40. For example the spikes 44 and holes 45 may be configured to provide friction between the two when in the position shown in FIG. 6*a*. Other means such as engaging projections and recesses could be used and a further option would be to use a relatively low bond double-sided adhesive tape between the under side of plate 43 and the upper side of the base 40.

Whilst the embodiments described herein conveniently incorporate an adhesive in the form of a VHB tape, it will be appreciated that other forms of adhesive including liquids and pastes could be used without departing from the scope of the disclosure.

Referring back to FIG. 1, in another aspect the disclosure provides a novel and useful means of mounting the hinge pillar 14, to the hinge base and, in particular, to the cover 12.

When installing toilet seat hinges, the positions of hinge fixings 11, covers 12 and pillars 14 must be manipulated to ensure that the seat is correctly located along fore and aft, and lateral, axes. Generally, changing the position of one component affects the positions of the others and so a trial installation is undertaken in which the components are loosely interconnected, the correct positions are established and noted, and the components then disassembled, tightened and fixed back in the established positions. The present disclosure proposes methods and apparatus which eliminate the need for pre-assembly and allow correct positioning of components, and secure fixing, from the outset.

In the foregoing we have described a method for correct positioning and fixing of the hinge base relative to the pan. Further adjustment is required between the pillar 14 and the cover 12. Previously, with the pillar directly attached to cover 12 using a fixing screw 25 any rotation of the pillar relative to the cover, to establish correct positioning, would loosen the fixing screw 25. Thus, once the correct positions had been established, the cover 12 would have to be removed and the screw 25 re-tightened as part of final assembly. This problem is addressed in a further aspect of the disclosure by mounting pillar 14 on an intermediate mount 26 using fixing screw 25. The intermediate mount 25 is configured to be a firm rotating fit within the cover 12 and thus the pivotal position of the pillar 14 relative to the cover can be established without any loosening of the connection between the pillar and the cover.

It will thus be appreciated that the disclosure, as least in the case of the various embodiments described, allow toilet seat hinge components to be positioned and fixed to a toilet pan effectively and without significant, or possibly any, trial assembly.

The above disclosure is described with reference to some embodiments. However, it is realized that other embodiments may be provided without departing from the scope of the disclosure.

The invention claimed is:

1. A hinge for mounting a toilet seat on a toilet pan, said hinge comprising:

a hinge base having a contact surface for adhesive engagement with a toilet pan and a mount for engagement with a toilet seat; and a spacing facility formed integrally with said hinge base and configured to maintain a space between said contact surface and said toilet pan, said spacing facility being further configured to deform into said hinge base, or fracture, upon displacement of said contact surface into engagement with said toilet pan.

2. The hinge according to claim 1 further including a fixing rod locatable through a hole in said toilet pan.

3. The hinge according to claim 1, wherein said hinge base comprises a fixing part which includes said contact surface, and a cover engageable over said fixing part.

4. The hinge according to claim 3, wherein said fixing part further includes an aperture through which said fixing rod can pass.

5. The hinge according to claim 1, wherein said contact surface has engaged therewith a bonding component that is adhesivised on both sides thereof.

6. The hinge according to claim 5, wherein said bonding component is formed from very high bond (VHB) tape.

7. The hinge according to claim 1 wherein said contact surface has apertures to receive said spacing facility as said contact surface is displaced into contact with said toilet pan.

* * * * *